US010801485B2

(12) United States Patent
Mou et al.

(10) Patent No.: US 10,801,485 B2
(45) **Date of Patent: *Oct. 13, 2020**

(54) GAS TRANSPORTATION DEVICE

(71) Applicant: Microjet Technology Co., Ltd., Hsinchu (TW)

(72) Inventors: Hao-Jan Mou, Hsinchu (TW); Chun-Lung Tseng, Hsinchu (TW); Che-Wei Huang, Hsinchu (TW); Chien-Tang Wen, Hsinchu (TW); Shih-Chang Chen, Hsinchu (TW); Yung-Lung Han, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 200 days.

This patent is subject to a terminal disclaimer.

(21) Appl. No.: 16/054,222

(22) Filed: Aug. 3, 2018

(65) Prior Publication Data

US 2019/0063418 A1 Feb. 28, 2019

(30) Foreign Application Priority Data

Aug. 31, 2017 (TW) ..... 106129726 A

(51) Int. Cl.

| | |
|---|---|
| ***F04B 43/04*** | (2006.01) |
| ***F04B 45/047*** | (2006.01) |
| ***F04B 39/12*** | (2006.01) |

(52) U.S. Cl.

CPC ..... *F04B 43/046* (2013.01); *F04B 39/121* (2013.01); *F04B 39/123* (2013.01); *F04B 45/047* (2013.01)

(58) Field of Classification Search

CPC ..... F04B 45/04; F04B 45/045; F04B 45/047; F04B 45/10; F04B 53/16; F04B 39/123; F04B 39/121; F04B 43/043; F04B 43/046

See application file for complete search history.

(56) References Cited

U.S. PATENT DOCUMENTS

2011/0070110 A1* 3/2011 Hirata ..... F04B 43/043 417/413.2
2011/0076170 A1* 3/2011 Fujisaki ..... F04B 45/047 417/415

(Continued)

FOREIGN PATENT DOCUMENTS

CN 2674145 Y 1/2005
CN 102046978 A 5/2011

(Continued)

OTHER PUBLICATIONS

JP2013151908 translation (Year: 2013).*
"Venturi effect—Wikipedia"; en.wikipedia.org/wiki/Venturi_effect). (Year: 2020).*

*Primary Examiner* — Patrick Hamo
*Assistant Examiner* — David N Brandt
(74) *Attorney, Agent, or Firm* — Birch, Stewart, Kolasch & Birch, LLP

(57) ABSTRACT

A gas transportation device includes a casing, a nozzle plate, a chamber frame, an actuator, an insulating frame and a conducting frame, which are stacked sequentially. The nozzle plate includes at least one bracket, a suspension plate and a through hole. The bracket includes a fixing part and a connecting part. A shape of the fixing part matches a shape of the fixing recess. The nozzle plate is accommodated within the accommodation space. A resonance chamber is defined by the actuator, the chamber frame and the suspension plate collaboratively. When the actuator is enabled, the nozzle plate is subjected to resonance and the suspension (Continued)

plate of the nozzle plate vibrates in the reciprocating manner. Consequently, the gas is transported to a gas-guiding chamber through the at least one vacant space and outputted from the discharging opening, thereby achieving the gas transportation and circulation.

19 Claims, 8 Drawing Sheets

(56) References Cited

U.S. PATENT DOCUMENTS

| | | | | |
|---|---|---|---|---|
| 2013/0071269 | A1* | 3/2013 | Fujisaki | F04B 43/046 417/413.2 |
| 2014/0377099 | A1* | 12/2014 | Hsueh | F04B 43/046 417/413.2 |
| 2019/0063418 | A1* | 2/2019 | Mou | F04B 43/046 |

FOREIGN PATENT DOCUMENTS

| | | | | |
|---|---|---|---|---|
| CN | 106062364 | A | 10/2016 | |
| JP | 62-70676 | A | 4/1987 | |
| JP | 2009-250132 | A | 10/2009 | |
| JP | 2013151908 | * | 8/2013 | F04B 45/04 |
| TW | M543870 | U | 6/2017 | |

* cited by examiner

GAS TRANSPORTATION DEVICE

FIELD OF THE INVENTION

The present disclosure relates to a gas transportation device, and more particularly to a miniature and silent gas transportation device for transporting gas at a high speed.

BACKGROUND OF THE INVENTION

In various fields such as pharmaceutical industries, computer techniques, printing industries or energy industries, the products are developed toward elaboration and miniaturization. The fluid transportation devices are important components that are used in for example micro pumps, micro atomizers, printheads or industrial printers. Therefore, it is important to provide an improved structure of the fluid transportation device.

With the rapid development of technology, the applications of gas transportation devices are becoming more and more diversified. For example, gas transportation devices are gradually popular in industrial applications, biomedical applications, medical care applications, heat dissipation applications, or even the wearable devices. It is obvious that the trends of designing gas transportation devices are toward the miniature structure and the larger flowrate.

In accordance with the existing technologies, the gas transportation device is assembled by stacking plural conventional mechanical parts. For achieving the miniature and slim benefits of the overall device, all mechanical parts are minimized or thinned. However, since the individual mechanical part is minimized, it is difficult to control the size precision and the assembling precision. Consequently, the product yield is low and inconsistent, or even the flow rate of the gas is not stable. Moreover, as the conventional gas transportation device is employed, since the outputted gas fails to be effectively collected or the component size is very small, the force of pushing the gas is usually insufficient. In other words, the flowrate of the gas transported by the gas transportation device is low.

Therefore, there is a need of providing a miniature gas transportation device applied in various devices to make the apparatus or the equipment utilizing the conventional gas transportation device to achieve small-size, miniature and silent benefits in order to eliminate the above drawbacks.

SUMMARY OF THE INVENTION

An object of the present disclosure provides a gas transportation device. With a design of a special fluid channel and a nozzle plate of the gas transportation device, it overcomes the problem that the gas transportation device cannot have a small size, be miniaturized, silent and control the size precision simultaneously.

Another object of the present disclosure provides a gas transportation device. With a design of a cuboidal resonance chamber and a special conduit, a Helmholtz resonance effect is produced by a piezoelectric plate and the cuboidal resonance chamber. Consequently, a great amount of gas is collected and transported at a high speed. The collected gas is in the ideal fluid state complying with the Bernoulli's principle. Consequently, the drawback of the prior art that the flow rate of the gas transportation is low is solved.

In accordance with an aspect of the present disclosure, a gas transportation device is provided for transporting gas flowing. The gas transportation device includes a casing, a nozzle plate, a chamber frame, an actuator, an insulating frame and a conducting frame. The casing includes at least one fixing recess, an accommodation space and a discharging opening. The accommodation space has a bottom surface. The nozzle plate includes at least one bracket, a suspension plate and a through hole. The at least one bracket comprises a fixing part and a connecting part, wherein a shape of the fixing part matches a shape of the at least one fixing recess. The at least one bracket is accommodated within the fixing recess, so as to position the nozzle plate accommodated within the accommodation space and form a gas-guiding chamber between the nozzle plate and the bottom surface of the accommodation space. The gas-guiding chamber is in communication with the discharging opening. The connecting part is connected between the suspension plate and the fixing part, and the suspension plate is elastically supported by the connecting part, so that the suspension plate undergoes the bending vibration in the reciprocating manner. Moreover, at least one vacant space is formed between the at least one bracket, the suspension plate and the casing. The chamber frame is supported and stacked on the suspension plate. The actuator is supported and stacked on the chamber frame. In response to a voltage applied to the actuator, the actuator undergoes the bending vibration in a reciprocating manner. The insulating frame is supported and stacked on the actuator. The conducting frame is supported and stacked on the insulating frame. A resonance chamber is defined by the actuator, the chamber frame and the suspension plate collaboratively. When the actuator is enabled, the nozzle plate is subjected to resonance to vibrate and move the suspension plate of the nozzle plate in the reciprocating manner. Consequently, the gas is transported to the gas-guiding chamber through the at least one vacant space and outputted from the discharging opening, thereby achieving the gas transportation and circulation.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

Figure 1:
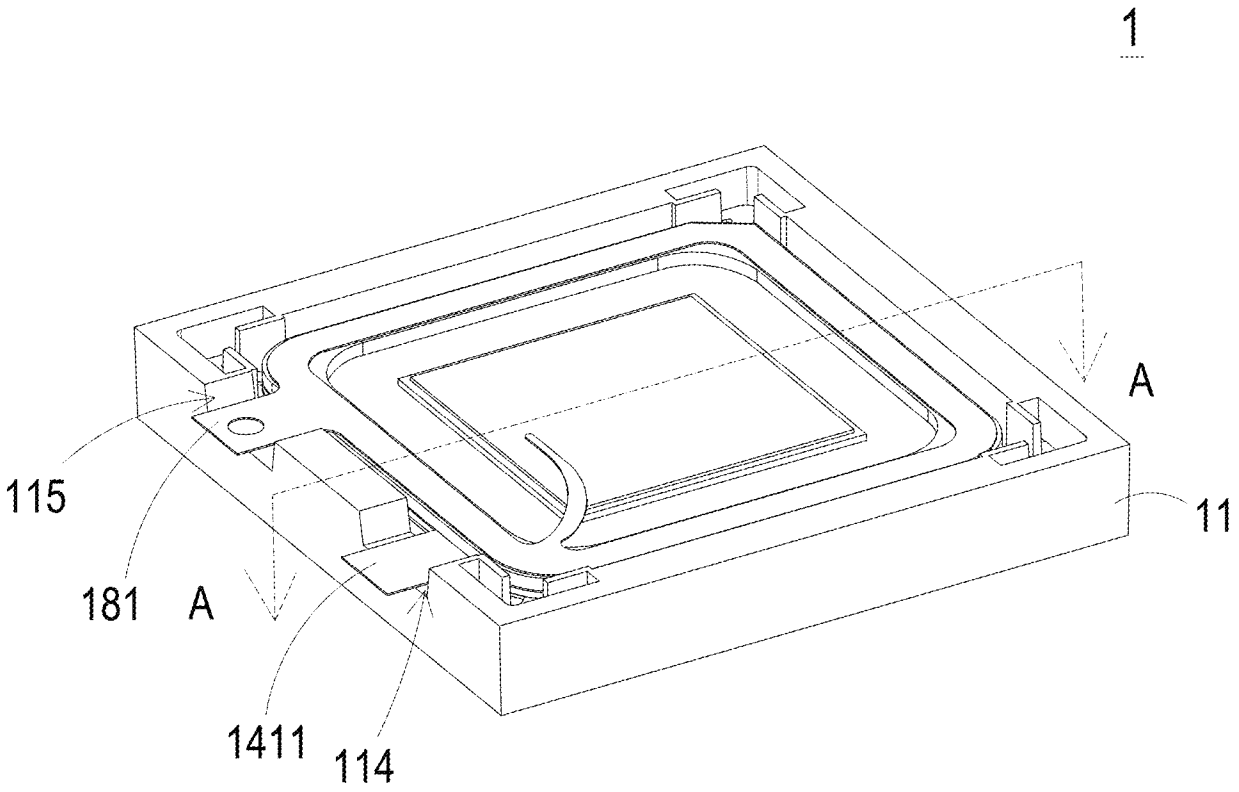
FIG. 1 is a schematic perspective view illustrating the outer appearance of a gas transportation device according to an embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Please refer to FIGS. 1, 2A, 2B, 3, 4, 5A, 5B and 5C. The present discourse provides a gas transportation device 1 including at least one casing 11, at least one fixing recess 113, at least one accommodation space 111, at least one discharging opening 112, at least one nozzle plate 12, at least one bracket 120, at least one suspension plate 121, at least one through hole 124, at least one fixing part 122, at least one connecting part 123, at least one gas-guiding chamber 19, at least one vacant space 125, at least one chamber frame 13, at least one actuator 14, at least one insulating frame 17, at least one conducting frame 18 and at least one resonance chamber 130. The number of the casing 11, the accommodation space 111, the discharging opening 112, the nozzle plate 12, the suspension plate 121, the through hole 124, the fixing part 122, the connecting part 123, the gas-guiding chamber 19, the chamber frame 13, the actuator 14, the insulating frame 17, the conducting frame 18 and the resonance chamber 130 is exemplified by one for each in the following embodiments but not limited thereto. It is noted that each of the casing 11, the accommodation space 111, the discharging opening 112, the nozzle plate 12, the suspension plate 121, the through hole 124, the fixing part 122, the connecting part 123, the gas-guiding chamber 19, the chamber frame 13, the actuator 14, the insulating frame 17, the conducting frame 18 and the resonance chamber 130 can also be provided in plural numbers.

Figure 2A:
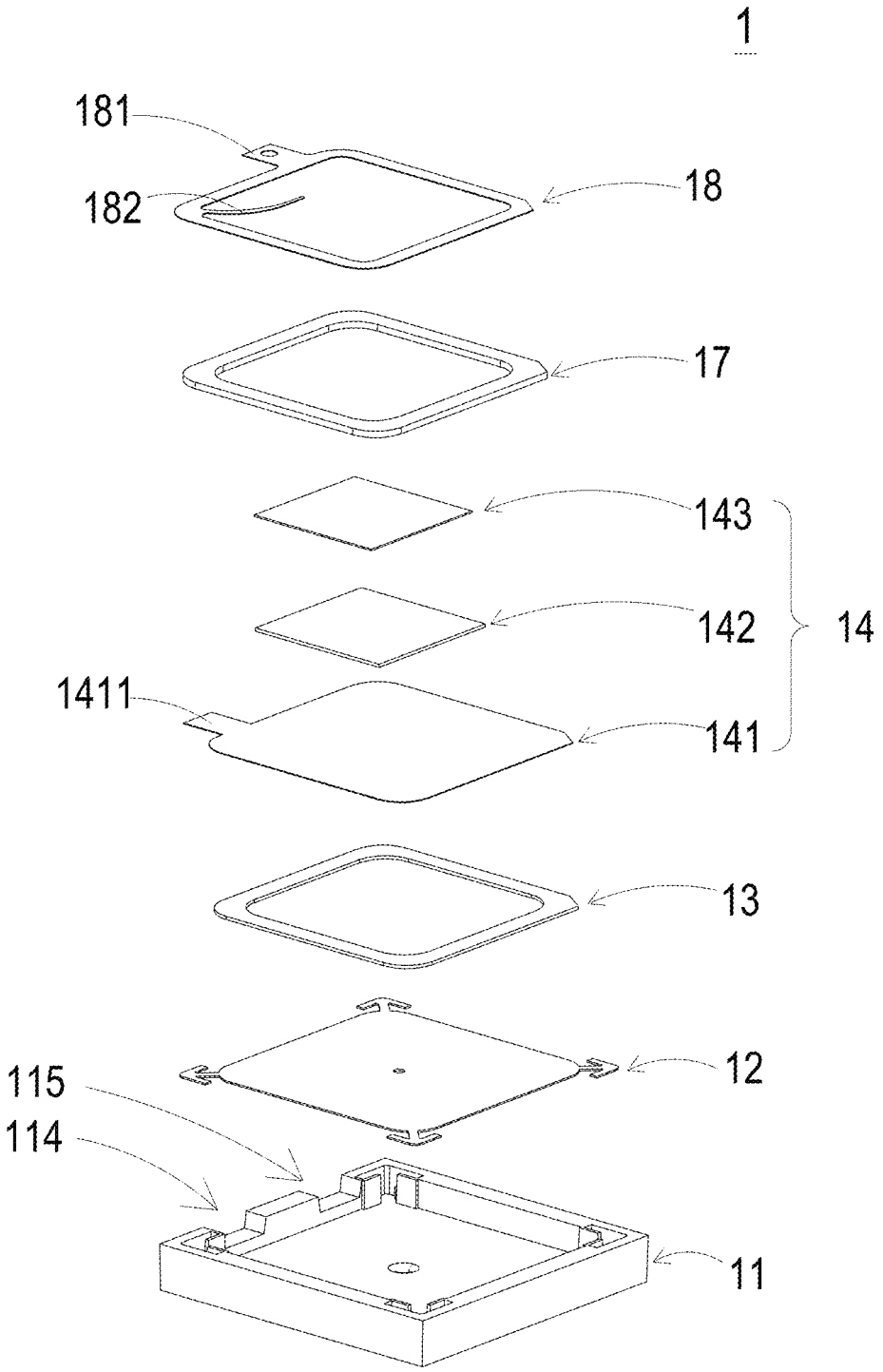
FIG. 2A is a schematic exploded view illustrating the gas transportation device of FIG. 1 and taken along a front side.
Figure 2B:
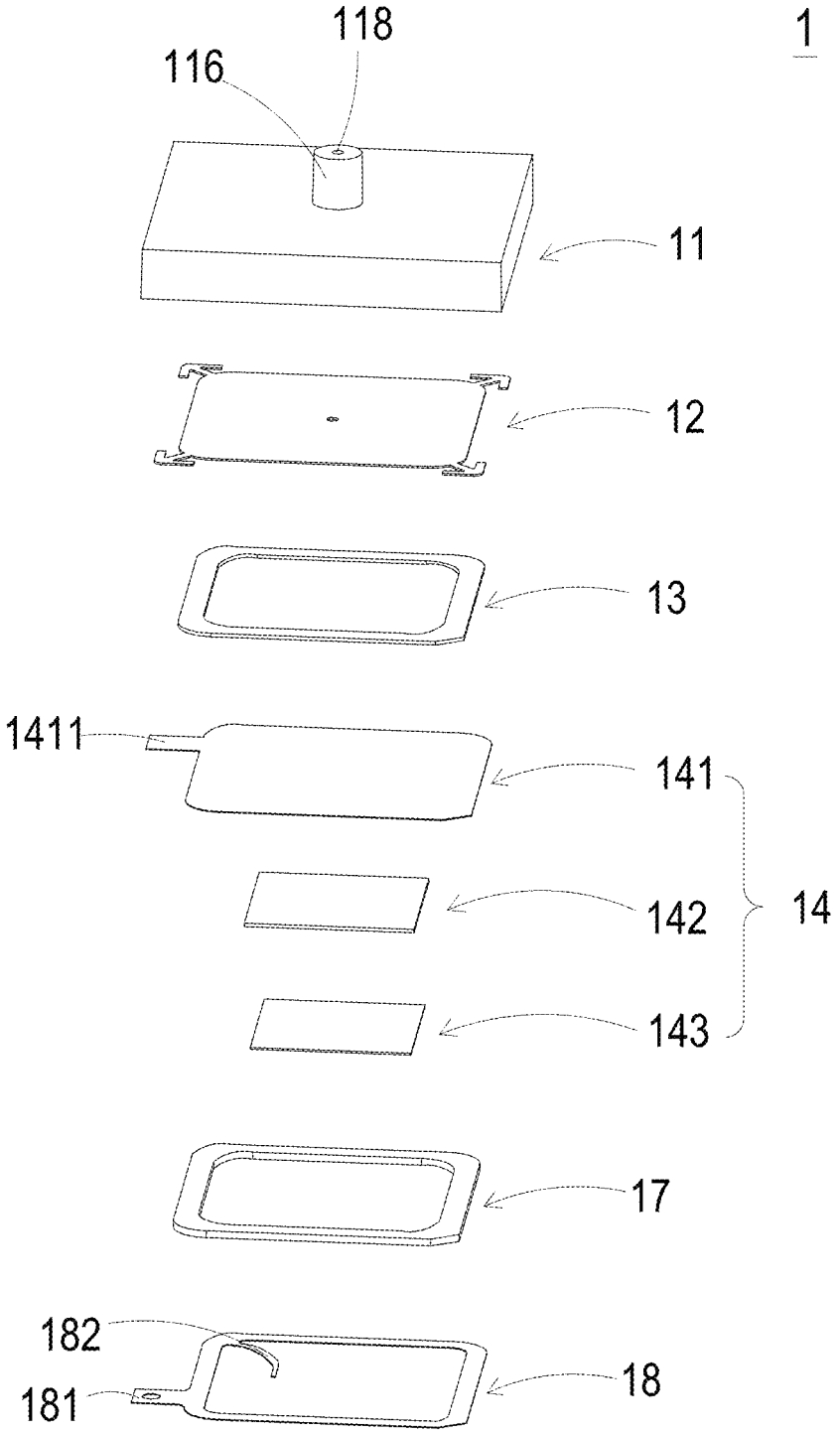
FIG. 2B is a schematic exploded view illustrating the gas transportation device of FIG. 1 and taken along the rear side.

Please refer to FIGS. 1, 2A and 2B. FIG. 1 is a schematic perspective view illustrating the outer appearance of a gas transportation device according to an embodiment of the present disclosure. FIG. 2A is a schematic exploded view illustrating the gas transportation device of FIG. 1 and taken along a front side. FIG. 2B is a schematic exploded view illustrating the gas transportation device of FIG. 1 and taken along the rear side. In this embodiment, the gas transportation device 1 is a miniature gas transportation structure for transporting a great deal of gas at a high speed. The gas transportation device 1 includes a casing 11, a nozzle plate 12, a chamber frame 13, an actuator 14, an insulating frame 17 and a conducting frame 18, which are stacked on each other sequentially.

Figure 3:
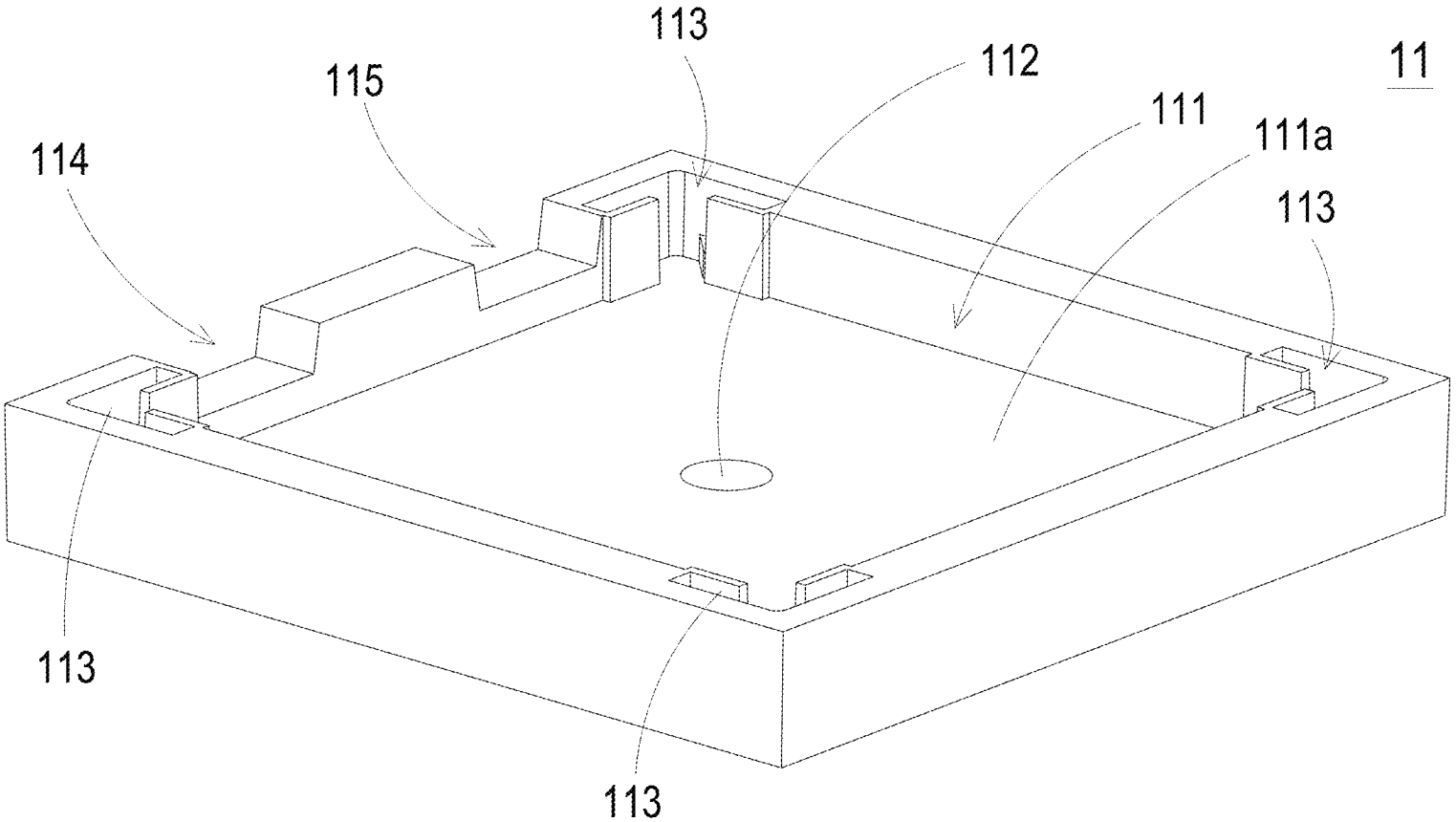
FIG. 3 is a schematic perspective view illustrating the casing of the gas transportation device as shown in FIG. 2A.
Figure 5A:
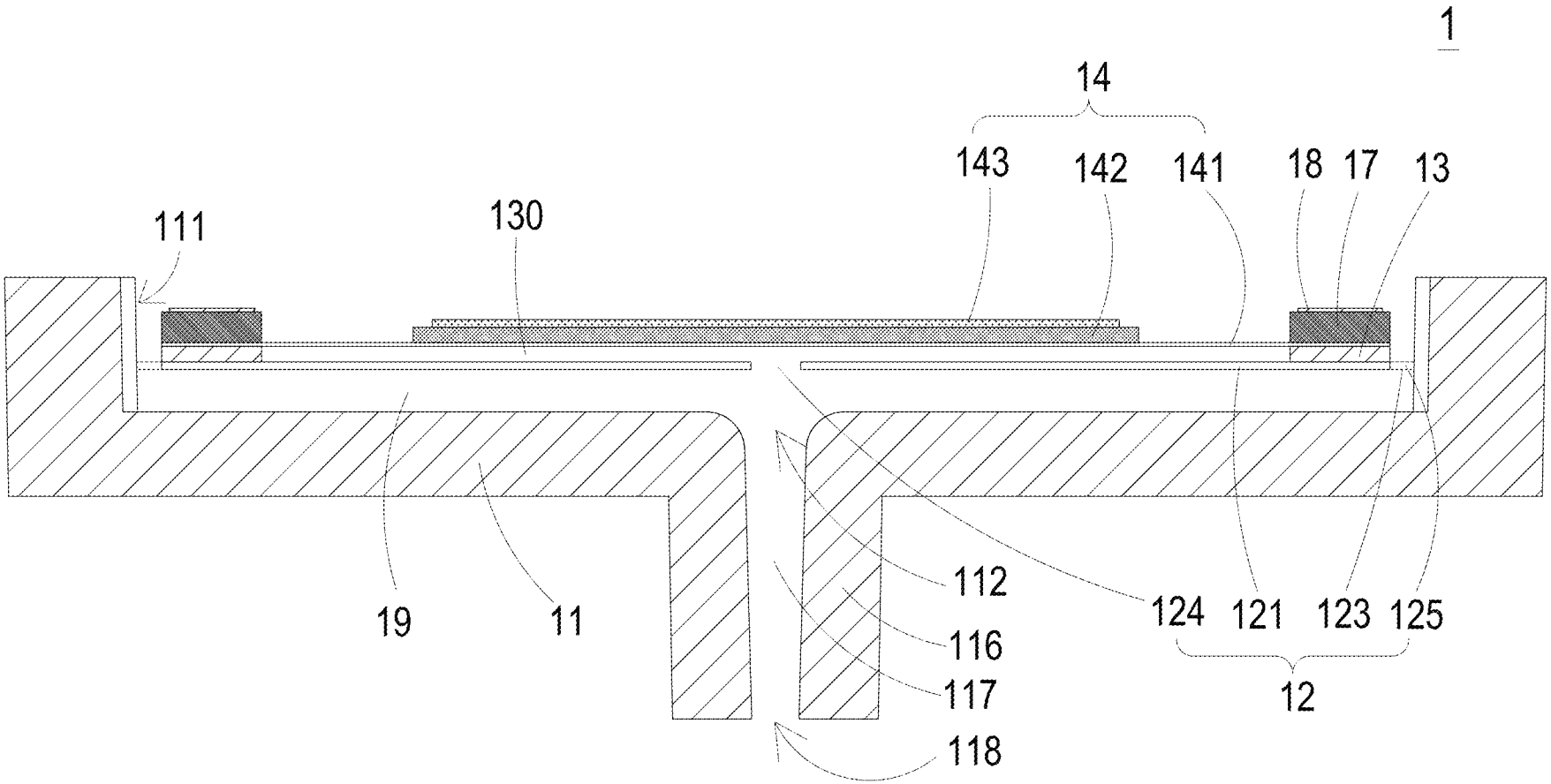
FIG. 5A is a schematic cross-sectional view illustrating the gas transportation device of FIG. 1 and taken along the line A-A.

FIG. 3 is a schematic perspective view illustrating the casing of the gas transportation device as shown in FIG. 2A. Please refer to FIGS. 2A, 2B and 3. In this embodiment, the casing 11 includes an accommodation space 111, a discharging opening 112, at least one fixing recess 113, a second notch 114, a first notch 115 and a conduit 116 (see FIG. 2B) The accommodation space 111 has a bottom surface 111*a*, and the accommodation space 111 is a square recessed structure concavely formed in the interior of the casing 11. That is, the bottom surface 111*a* of the accommodation space 111 is a square surface, but not limited thereto. In some embodiments, the accommodation space 111 has a circular profile, an elliptic profile, a triangular profile or a polygonal profile. The accommodation space 111 is used to accommodate the combination of the nozzle plate 12, the chamber frame 13, the actuator 14, the insulating frame 17 and the conducting frame 18, which are stacked on each other. The discharging opening 112 runs through a middle region of the bottom surface 111*a* for allowing the gas to flow therethrough. As shown in FIG. 5A, the discharging opening 112 is in communication with the conduit 116. The nozzle plate 12 is fixed in the at least one fixing recess 113. In this embodiment, the casing 11 has four fixing recesses 113, which are arranged adjacent to four corners of the accommodation space 111, respectively. Preferably but not exclusively, the fixing recesses 113 are arrow-shaped recesses structures. The number and shapes of the fixing recesses 113 are not restricted and can be varied according to the practical requirements. As shown in FIGS. 2B and 3, the conduit 116 is a long columnar hollow structure. The conduit 116 is extended outwardly from the discharging opening 112 of the casing 11 and included an output channel 117 (see FIG. 5A) and an outlet 118. The output channel 117 of the conduit 116 is in communication with the accommodation space 111 through the discharging opening 112. The output channel 117 of the conduit 116 is in communication with the external portion of the casing 11 through the outlet 118. The diameter of the discharging opening 112 is larger than the diameter of the outlet 118 (see FIG. 5A). In other words, the internal diameter of the output channel 117 is tapered from the discharging opening 112 side to the outlet 118 side. For example, the output channel 117 has a cone shape. The diameter of the discharging opening 112 is in the range between 0.85 mm and 1.25 mm. The diameter of the outlet 118 is in the range between 0.8 mm and 1.2 mm. When the gas is introduced into the conduit 116 from the discharging opening 112 and is outputted from the output channel 117, the gas is obviously collected so that a great amount of the collected gas is quickly ejected from the output channel 117 of the conduit 116. It is noted that numerous modifications and alterations may be made while retaining the teachings of the disclosure. For example, in some other embodiments, the casing 11 is not equipped with the conduit. That is, the gas can be directly outputted from the casing 11 through the discharging opening 112.

Figure 4:
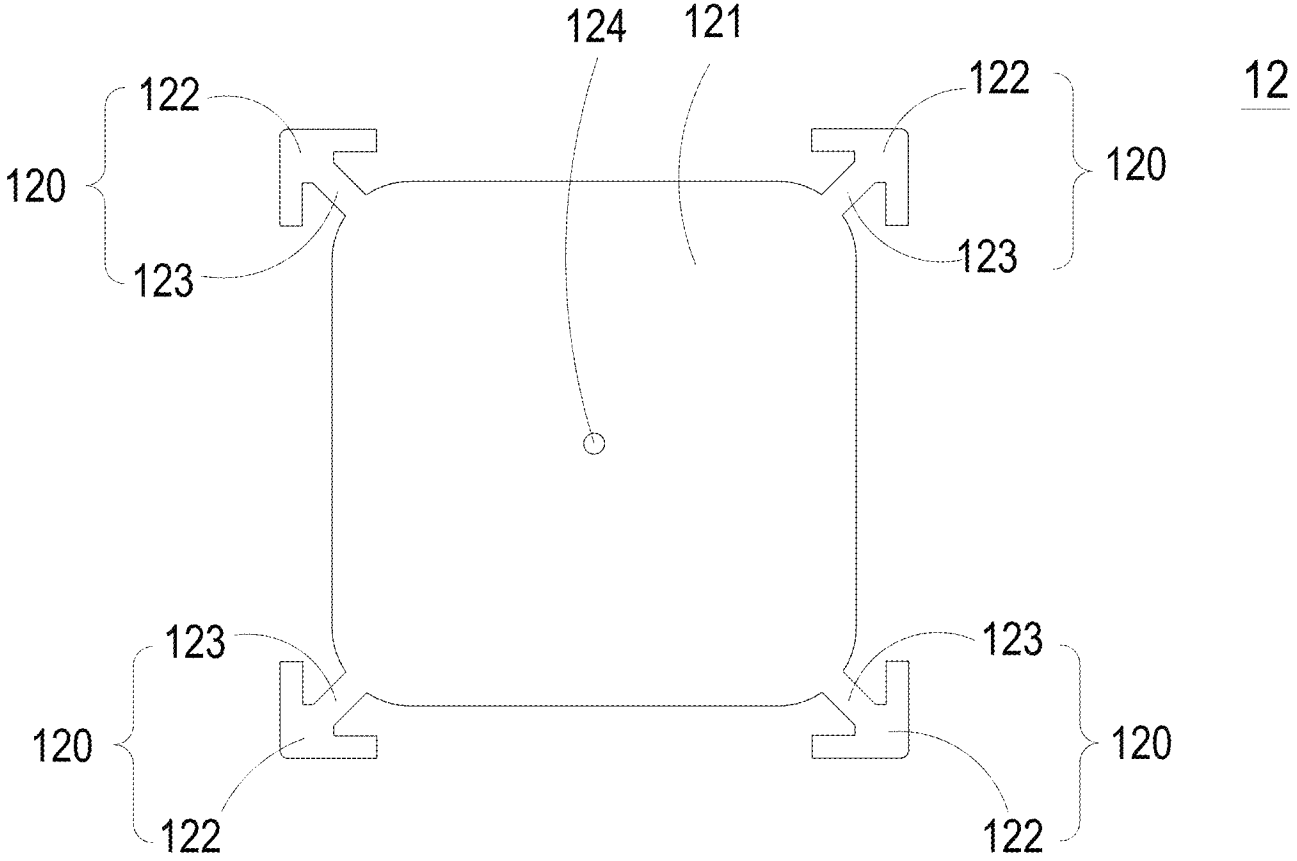
FIG. 4 is a schematic top view illustrating the nozzle plate of the gas transportation device as shown in FIG. 2A.

Please refer to FIGS. 2A, 2B and 4. FIG. 4 is a schematic top view illustrating the nozzle plate of the gas transportation device as shown in FIG. 2A. In this embodiment, the nozzle plate 12 includes at least one bracket 120, a suspension plate 121 and a through hole 124. The suspension plate 121 is a piece structure permitted to undergo bending vibration. The shape of the suspension plate 121 corresponds to the shape of the accommodation space 111, but not limited thereto. For example, the suspension plate 121 has a square shape, a circular shape, an elliptic shape, a triangular shape or a polygonal shape. The through hole 124 runs through a middle region of the suspension plate 121 for allowing the gas to flow therethrough. In this embodiment, the nozzle plate 12 includes four brackets 120, but not limited thereto. The number and type of the brackets 120 corresponds to the number and type of the fixing recesses 113. Moreover, the number and type of the brackets 120 may be varied according to the practical requirements. In this embodiment, each bracket 120 includes a fixing part 122 and a connecting part 123. As shown in FIG. 3, the fixing recess 113 and the fixing part 122 are L-shaped respectively, so as to match each other. While the shape of fixing part 122 is L-shaped and the shape of the fixing recess 113 is L-shaped, the fixing part 122 is accommodated within the fixing recess 113. Since the fixing part 122 matches the fixing recess 113, the fixing part 122 can be positioned in the fixing recess 113 at enhanced strength. Since the bracket 120 is fixed in the fixing recess 113, the nozzle plate 12 is accommodated within the accommodation space 111 of the casing 11. Moreover, since the fixing part 122 and the fixing recess 113 are engaged with each other, the nozzle plate 12 can be positioned in the accommodation space 111 of the casing 11 more quickly and precisely. Since the structures of the nozzle plate 12 and the casing 11 are simple, they are assembled more easily. Under this circumstance, the size precision of the gas transportation device is enhanced.

The connecting part 123 is connected between the suspension plate 121 and the fixing part 122. Moreover, the connecting part 123 is elastic, so that the suspension plate 121 is permitted to undergo bending vibration in the reciprocating manner. In this embodiment, plural vacant spaces 125 are formed between the brackets 120, the suspension plate 121 and the accommodation space 111 of the casing 11 (see FIG. 5A). The gas can be transported to the region between the accommodation space 111 and the suspension plate 121 through the vacant spaces 125. Consequently, the gas transportation device 1 can transport the gas.

Please refer to FIGS. 2A, 2B and 5A. FIG. 5A is a schematic cross-sectional view illustrating the gas transportation device of FIG. 1 and taken along the line A-A. A resonance chamber 130 is defined by the nozzle plate 12, the chamber frame 13 and the actuator 14 collaboratively. The chamber frame 13 may be a square frame structure. For complying with the chamber frame 13, the resonance chamber 130 may be a cuboidal resonance chamber. The capacity of the resonance chamber 130 is in the range between 6.3 cubic millimeter and 186 cubic millimeter. Moreover, the actuator 14 includes a carrier plate 141, an adjusting resonance plate 142 and a piezoelectric plate 143. The carrier plate 141 may be a metal plate. A second pin 1411 is extended from an edge of the carrier plate 141 to receive electric power. The adjusting resonance plate 142 is attached on the carrier plate 141. The adjusting resonance plate 142 may also be a metal plate. The piezoelectric plate 143 is disposed on the adjusting resonance plate 142. The adjusting resonance plate 142 is arranged between the piezoelectric plate 143 and the carrier plate 141. When the piezoelectric plate 143 is subjected to deformation in response to the electric power according to the piezoelectric effect, the adjusting resonance plate 142 is used as a buffering element between the piezoelectric plate 143 and the carrier plate 141 for adjusting the vibration frequency of the carrier plate 141. The thickness of the adjusting resonance plate 142 is thicker than that of the carrier plate 141. The vibration frequency of the actuator 14 is adjusted according to the thickness of the adjusting resonance plate 142. Consequently, the vibration frequency of the actuator 14 is controlled to be in the range between 10 KHz and 30 KHz. In this embodiment, the thickness of the carrier plate 141 is in the range between 0.04 mm and 0.06 mm. The thickness of the adjusting resonance plate 142 is in the range between 0.1 mm and 0.3 mm. The thickness of the piezoelectric plate 143 is in the range between 0.05 mm and 0.15 mm.

Please refer to FIGS. 2A, 2B and 5A. The nozzle plate 12 is accommodated within the accommodation space 111 of the casing 11. The gas-guiding chamber 19 is formed between the nozzle plate 12 and the accommodation space 111. The gas-guiding chamber 19 is in communication with the discharging opening 112. The height of the gas-guiding chamber 19 is in the range between the 0.2 mm and 0.8 mm.

Please refer to FIGS. 1, 2A and 2B. The insulating frame 17 and the conducting frame 18 are disposed on the actuator 14. The conducting frame 18 includes a first pin 181 and an electrode 182. The electrode 182 is electrically connected to the piezoelectric plate 143 of the actuator 14. The first pin 181 of the conducting frame 18 and the second pin 1411 of the carrier plate 141 are respectively protruded outwardly from the first notch 115 and the second notch 114 of the casing 11 in order to receive the electric power from the external power source (not shown). Consequently, a loop is defined by the carrier plate 141, the adjusting resonance plate 142, the piezoelectric plate 143 and the conducting frame 18 collaboratively. The insulating frame 17 is arranged between the conducting frame 18 and the carrier plate 141 so that the direct contact between the conducting frame 18 and the carrier plate 141 is prevented to solve short-circuited problem.

Figure 5B:
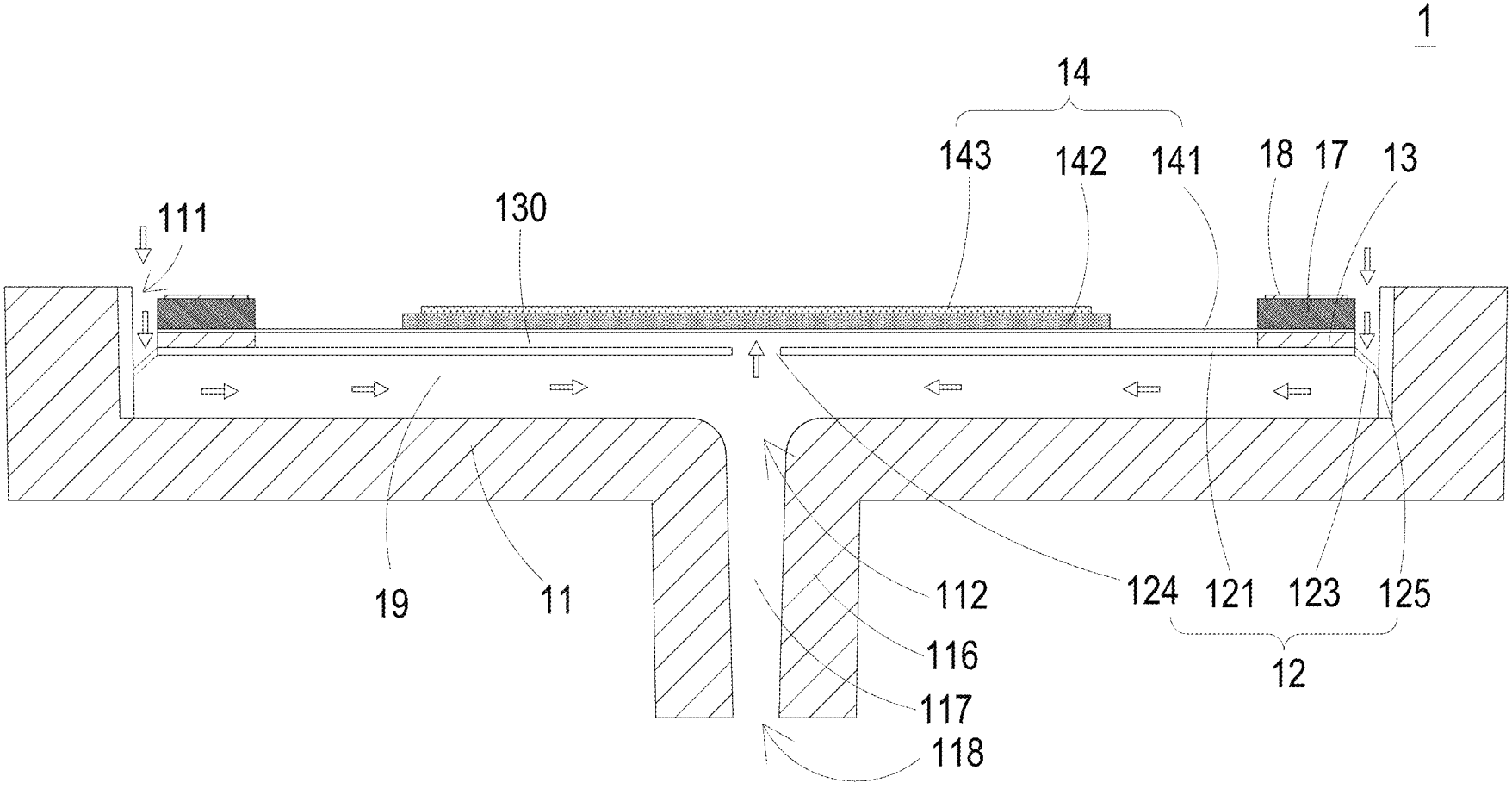
FIGS. 5B and 5C schematically illustrate the actions of the gas transportation device of FIG. 5A.
Figure 5C:
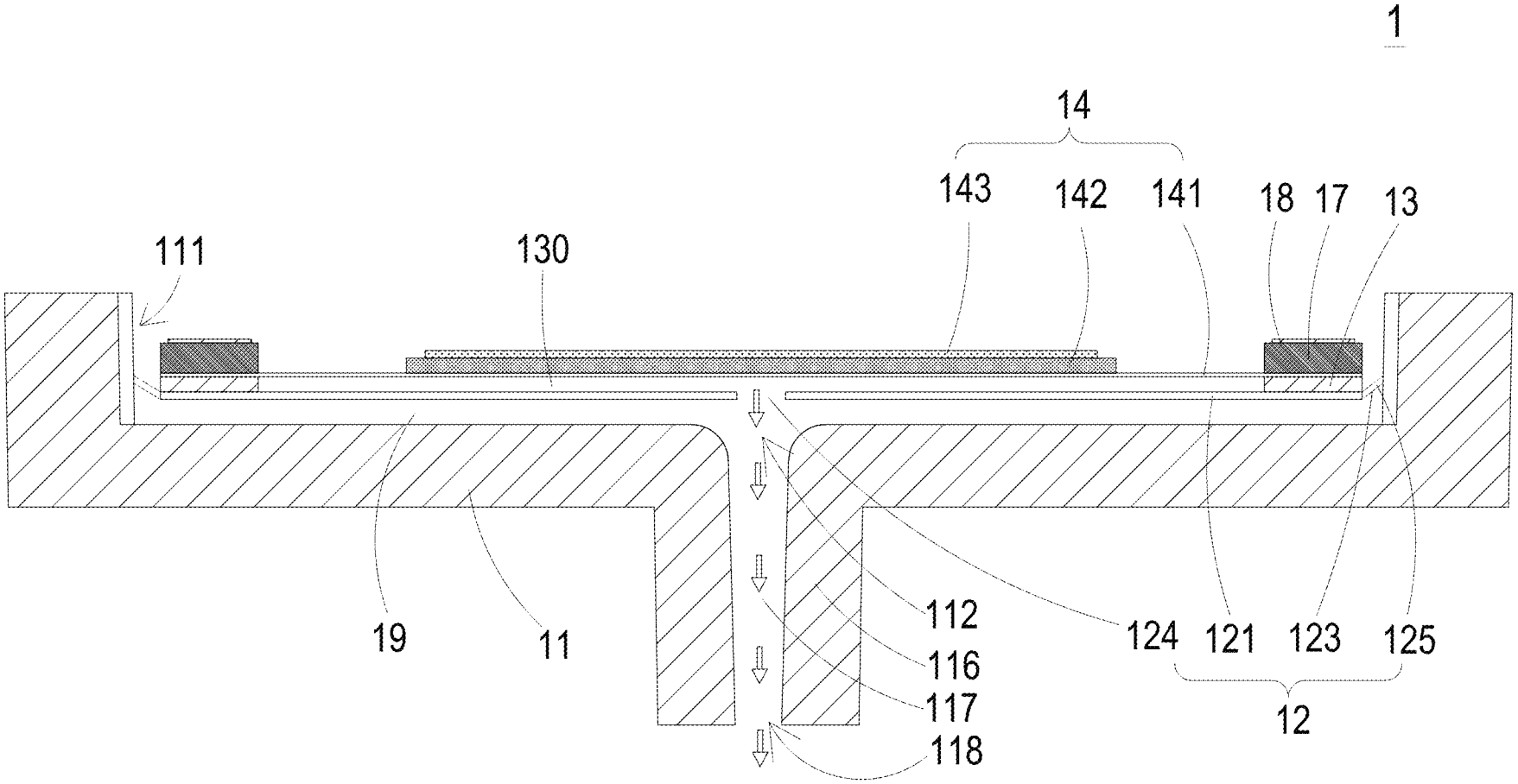

Please refer to FIGS. 5A, 5B and 5C. FIGS. 5B and 5C schematically illustrate the actions of the gas transportation device of FIG. 5A. As shown in FIG. 5A, the gas transportation device 1 is disabled and in an initial state. The casing 11, the nozzle plate 12, the chamber frame 13, the actuator 14, the insulating frame 17 and the conducting frame 18 are stacked sequentially to be assembled as the gas transportation device 1 of the present disclosure. The cuboidal resonance chamber 130 is defined by the nozzle plate 12, the chamber frame 13 and the actuator 14 collaboratively. In this embodiment, by controlling the gas vibration frequency of the cuboidal resonance chamber 130 to be close to the piezoelectric frequency of the suspension plate 121, a Helmholtz resonance effect is produced by the cuboidal resonance chamber 130 and the suspension plate 121. Consequently, the gas transfer efficiency is enhanced. Please refer to FIG. 5B. When the actuator 14 is enabled and the piezoelectric plate 143 vibrates upwardly, the suspension plate 121 of the nozzle plate 12 vibrates upwardly. Meanwhile, the gas is inhaled into the gas-guiding chamber 19 through the plural vacant spaces 125, and then the gas is transported to the cuboidal resonance chamber 130 through the through hole 124. Consequently, the pressure of the gas in the cuboidal resonance chamber 130 is increased, and a pressure gradient is generated. Please refer to FIG. 5C. When the piezoelectric plate 143 vibrates downwardly, the suspension plate 121 of the nozzle plate 12 vibrates downwardly. Meanwhile, the gas flows out of the cuboidal resonance chamber 130 quickly through the through hole 124 and pushes the air in the gas-guiding chamber 19. Then, the gas is transported to the conduit 116, which is tapered from the discharging opening 112 side to the outlet 118 side, through the discharging opening 112 so as to collect the gas. Consequently, a great amount of the collected gas, which is in an ideal fluid state complying with the Bernoulli's principle, is quickly ejected from the output channel 117 of the conduit 116. According to the principle of inertial, the gas pressure in the cuboidal resonance chamber 130 is lower than the equilibrium gas pressure. Consequently, the gas is introduced into the cuboidal resonance chamber 130 again. As the piezoelectric plate 143 vibrates upwardly or downwardly in the reciprocating manner, the vibration frequency of the cuboidal resonance chamber 130 are substantially equal to the vibration frequency of the piezoelectric plate 143. Consequently, the Helmholtz resonance effect is produced to transport a great amount of gas at a high speed.

From the above descriptions, the present disclosure provides the gas transportation device. When the voltage is applied to the piezoelectric plate, the piezoelectric plate vibrates upwardly or downwardly to drive the vibration of the cuboidal resonance chamber. Since the pressure in the cuboidal resonance chamber is subjected to a change, the purpose of transporting the gas is achieved. Moreover, since the L-shaped fixing part and the L-shaped fixing recess are engaged with each other, the nozzle plate can be easily and precisely positioned in the accommodation space of the casing. That is, the gas transportation device of the present disclosure is miniature and has enhanced size precision. Since the contact area between the bracket and the casing is increased, the connecting capability of the bracket is enhanced. Moreover, since the vibration frequency of the cuboidal resonance chamber is substantially equal to the vibration frequency of the piezoelectric plate, the Helmholtz resonance effect is produced to transport a great amount of gas at a high speed. Moreover, since the internal diameter of the output channel of the conduit is tapered from the discharging opening side to the outlet side, the gas is further collected. The collected gas is in the ideal fluid state complying with the Bernoulli's principle. Consequently, the purpose of transporting the gas at the high speed is achieved.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A gas transportation device for transporting gas, comprising: a casing comprising an accommodation space, a first notch and a discharging opening, wherein the accommodation space has a bottom surface; a nozzle plate comprising a suspension plate and a through hole, the nozzle plate is positionally accommodated within the accommodation space to form a gas-guiding chamber between the nozzle plate and the bottom surface of the accommodation space, wherein the gas-guiding chamber is in communication with the discharging opening, wherein at least one vacant space is formed between the suspension plate and the casing;

a chamber frame supported and stacked on the suspension plate; an actuator supported and stacked on the chamber frame, wherein in response to a voltage applied to the actuator, the actuator undergoes a bending vibration, wherein the actuator comprises: a carrier plate supported and stacked on the chamber frame; an adjusting resonance plate supported and stacked on the carrier plate; and a piezoelectric plate supported and stacked on the adjusting resonance plate, wherein when the voltage is applied to the piezoelectric plate, the carrier plate and the adjusting resonance plate undergo a bending vibration in the reciprocating manner; an insulating frame supported and stacked on the actuator; and a conducting frame supported and stacked on the insulating frame and comprising a first pin, wherein the first pin of the conducting frame is positioned in the first notch to protrude out of the casing, wherein a resonance chamber is defined by the actuator, the chamber frame and the suspension plate collaboratively, wherein when the actuator is enabled, the nozzle plate is subjected to resonance to vibrate and move the suspension plate of the nozzle plate in the reciprocating manner, so that the gas is transported to the gas-guiding chamber through the at least one vacant space and outputted from the discharging opening.

2. The gas transportation device according to claim 1, wherein the nozzle plate has at least one bracket, the at least one bracket comprises a fixing part and a connecting part, wherein a shape of the fixing part matches a shape of the at least one fixing recess, and the at least one bracket is accommodated within the fixing recess, and the connecting part is connected between the suspension plate and the fixing part, wherein the suspension plate is elastically supported by the connecting part, so that the suspension plate undergoes a bending vibration.

3. The gas transportation device according to claim 1, wherein the accommodation space comprises one selected from the group consisting of a square profile, a circular profile, an elliptic profile, a triangular profile and a polygonal profile.

4. The gas transportation device according to claim 1, wherein the suspension plate comprises one selected from the group consisting of a square profile, a circular profile, an elliptic profile, a triangular profile and a polygonal profile.

5. The gas transportation device according to claim 1, wherein a thickness of the adjusting resonance plate is thicker than a thickness of the carrier plate.

6. The gas transportation device according to claim 1, wherein the carrier plate comprises a second pin, and the casing comprises a second notch, wherein the second pin of the carrier plate is positioned in the second notch to protrude out of the casing.

7. The gas transportation device according to claim 1, wherein the conducting frame comprises an electrode, and the electrode is electrically connected to the piezoelectric plate.

8. The gas transportation device according to claim 1, wherein a vibration frequency of the piezoelectric plate is in a range between the 10 kHz and 30 kHz.

9. The gas transportation device according to claim 1, wherein a conduit is extended outwardly from the discharging opening of the casing, and the conduit comprises an output channel and an outlet, wherein the output channel is in communication with the accommodation space through the discharging opening, and the output channel is in communication with an external portion of the casing through the outlet.

10. The gas transportation device according to claim 9, wherein the output channel has a cone shape and an internal diameter of the output channel is tapered from a side of the discharging opening to a side of the outlet.

11. The gas transportation device according to claim 9, wherein a diameter of the discharging opening is in a range between 0.85 mm and 1.25 mm, and a diameter of the outlet is in a range between 0.8 mm and 1.2 mm.

12. The gas transportation device according to claim 1, wherein a thickness of the carrier plate is in a range between 0.04 mm and 0.06 mm.

13. The gas transportation device according to claim 1, wherein a thickness of the adjusting resonance plate is in a range between 0.1 mm and 0.3 mm.

14. The gas transportation device according to claim 1, wherein a thickness of the piezoelectric plate is in a range between 0.05 mm and 0.15 mm.

15. The gas transportation device according to claim 1, wherein a height of the gas-guiding chamber is in a range between the 0.2 mm and 0.8 mm.

16. The gas transportation device according to claim 1, wherein a capacity of the resonance chamber is in a range between 6.3 cubic millimeters and 186 cubic millimeters.

17. A gas transportation device for transporting gas, comprising:

at least one casing comprising at least one fixing recess, at least one accommodation space, a first notch and at least one discharging opening, wherein the accommodation space has a bottom surface; at least one nozzle plate comprising at least one bracket, at least one suspension plate and at least one through hole, the at least one bracket comprising at least one fixing part and at least one connecting part, wherein a shape of the fixing part matches a shape of the at least one fixing recess, and the at least one bracket is accommodated within the fixing recess, so as to position the nozzle plate accommodated within the accommodation space and form at least one gas-guiding chamber between the nozzle plate and the bottom surface of the accommodation space, wherein the gas-guiding chamber is in communication with the discharging opening, and the connecting part is connected between the suspension plate and the fixing part, wherein the suspension plate is elastically supported by the connecting part, so that the suspension plate undergoes a bending vibration in the reciprocating manner, wherein at least one vacant space is formed between the at least one bracket, the suspension plate and the casing; at least one chamber frame supported and stacked on the suspension plate; at least one actuator supported and stacked on the chamber frame, wherein in response to a voltage applied to the actuator, the actuator undergoes a bending vibration, wherein the at least one actuator comprises: a carrier plate supported and stacked on the chamber frame; an adjusting resonance plate supported and stacked on the carrier plate; and a piezoelectric plate supported and stacked on the adjusting resonance plate, wherein when the voltage is applied to the piezoelectric plate, the carrier plate and the adjusting resonance plate undergo a bending vibration; at least one insulating frame supported and stacked on the actuator; and at least one conducting frame supported and stacked on the insulating frame and comprising a first pin, wherein the first pin of the conducting frame is positioned in the first notch to protrude out of the casing, wherein at least one resonance chamber is defined by the actuator, the chamber frame and the suspension plate collaboratively, wherein when the actuator is enabled, the nozzle plate is subjected to resonance to vibrate and move the suspension plate of the nozzle plate, so that the gas is transported to the gas-guiding chamber through the at least one vacant space and outputted from the discharging opening.

18. The gas transportation device according to claim 1, wherein the casing has at least one fixing recess.

19. The gas transportation device according to claim 2, wherein the fixing part is L-shaped, and the fixing recess is L-shaped.

* * * * *